US010844625B2

(12) United States Patent
Annas

(10) Patent No.: US 10,844,625 B2
(45) Date of Patent: Nov. 24, 2020

(54) SUPPORT POLE AND STAKE FOR NET SUPPORT SYSTEM

(71) Applicant: SAAB BARRACUDA LLC, Lillington, NC (US)

(72) Inventor: David W. Annas, Lillington, NC (US)

(73) Assignee: SAAB BARRACUDA LLC, Lillington, NC (US)

( * ) Notice: Subject to any disclaimer, the term of this patent is extended or adjusted under 35 U.S.C. 154(b) by 0 days.

(21) Appl. No.: 16/255,428

(22) Filed: Jan. 23, 2019

(65) Prior Publication Data

US 2020/0232248 A1 Jul. 23, 2020

(51) Int. Cl.
*E04H 15/60* (2006.01)
*E04H 15/62* (2006.01)
*E04H 15/54* (2006.01)

(52) U.S. Cl.
CPC ..... *E04H 15/60* (2013.01); *E04H 15/54* (2013.01); *E04H 15/62* (2013.01)

(58) Field of Classification Search
CPC ..... E04H 15/60; E04H 15/64; E04H 15/62; F41H 3/02
See application file for complete search history.

(56) References Cited

U.S. PATENT DOCUMENTS 484,998 A * 10/1892 Comstock ..... E04H 15/62 135/118
1,592,128 A * 7/1926 Steinbreder ..... E04H 15/62 135/118
2,149,081 A * 2/1939 Wright ..... E04H 15/62 135/118
3,425,428 A * 2/1969 Schwartz ..... E04H 15/60 135/114
3,456,660 A * 7/1969 Borchardt ..... E04H 15/62 135/118
3,621,858 A * 11/1971 Steele ..... E04H 15/04 135/87

(Continued)

FOREIGN PATENT DOCUMENTS

AU 2013219223 A1 4/2014
DE 6922480 U 11/1970

(Continued)

OTHER PUBLICATIONS

RolaTube; ULCANS Ultra-Lightwieght Camouflage Netting System User Guide; Retrieved from: http://www.rolatube-expeditionary-systems.com/wp-content/uploads/2018/01/ULCANS-User-Guide-V6-US.pdf; 4 pages.

(Continued)

*Primary Examiner* — Noah Chandler Hawk
(74) *Attorney, Agent, or Firm* — Barnes & Thornburg, LLP

(57) ABSTRACT

A net support system for supporting a net may include a support pole configured to hold up a net, one or more stakes configured to hold the net to a ground surface; and a shape disrupter configured to interface with the support pole and to hold up the net. The support pole and each of the one or more stakes are non-metallic, non-conductive, and radar transparent. Each of the one or more stakes may have a central rib. A storage case may be provided for storing the plurality of shape disrupters, the plurality of support poles, and the plurality of stakes.

10 Claims, 10 Drawing Sheets

(56) References Cited

U.S. PATENT DOCUMENTS

| | | | | |
|---|---|---|---|---|
| 3,732,878 | A * | 5/1973 | Blankemeyer | E04H 15/62 135/118 |
| 3,788,336 | A * | 1/1974 | Steffes | E04H 15/62 135/118 |
| 4,021,974 | A | 5/1977 | Edwards | |
| 4,441,518 | A | 4/1984 | Hogan et al. | |
| 4,750,508 | A * | 6/1988 | Tatoian | E04H 15/003 135/118 |
| 5,477,876 | A * | 12/1995 | Moss | E04H 15/26 135/100 |
| 5,593,239 | A | 1/1997 | Sallee | |
| 5,918,614 | A * | 7/1999 | Lynch | E04H 15/18 135/114 |
| 6,523,558 | B1 * | 2/2003 | Gillis | E04H 15/60 135/119 |
| 7,140,375 | B2 * | 11/2006 | Norris | E04H 15/60 135/119 |
| 7,353,833 | B1 * | 4/2008 | Palmer | E04H 15/60 135/118 |
| 8,360,700 | B2 | 1/2013 | Wienke | |
| 2001/0022189 | A1 | 9/2001 | Hexels | |
| 2009/0084043 | A1 | 4/2009 | Tarbet et al. | |
| 2019/0218815 | A1 * | 7/2019 | Cauley, Jr. | E02D 5/80 |

FOREIGN PATENT DOCUMENTS

| | | |
|---|---|---|
| EP | 0199851 A1 | 11/1986 |
| EP | 1464914 B1 | 2/2006 |

OTHER PUBLICATIONS

Action Surplus; Camouflage Net Support System; Retrieved from: http://www.actionsurpluseugene.com/cammouflage-net-support-system/; 3 pages.

PicClick.com; Military Camo Camouflage Net Support System Aluminum Antenna Mast Poles Used; Retrieved from: https://picclick.com/Military-Camo-Camouflage-Net-Support-System-Aluminum-Antenna-181367372114.html; 5 pages.

US Army Gear; US Military Camo Camouflage Net Support System 12 Poles Bag 18 Stakes Spreaders; Retrieved from: http://usarmygear.net/shop/gears/us-military-camo-camouflage-net-support-system-12-poles-bag-18-stakes-spreaders; 3 pages.

FibroTex; Observation Post; Retrieved from: http://www.fibrotex-tech.com/observation-post; 5 pages.

Coleman's Military Surplus; Support System for Camo Netting; Retrieved from: https://colemans.com/shop/military-tents/support-system-for-camo-netting/; 4 pages.

* cited by examiner

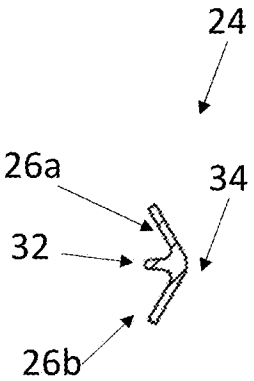
FIG. 18
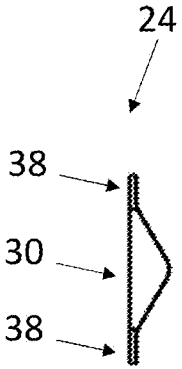
FIG. 17
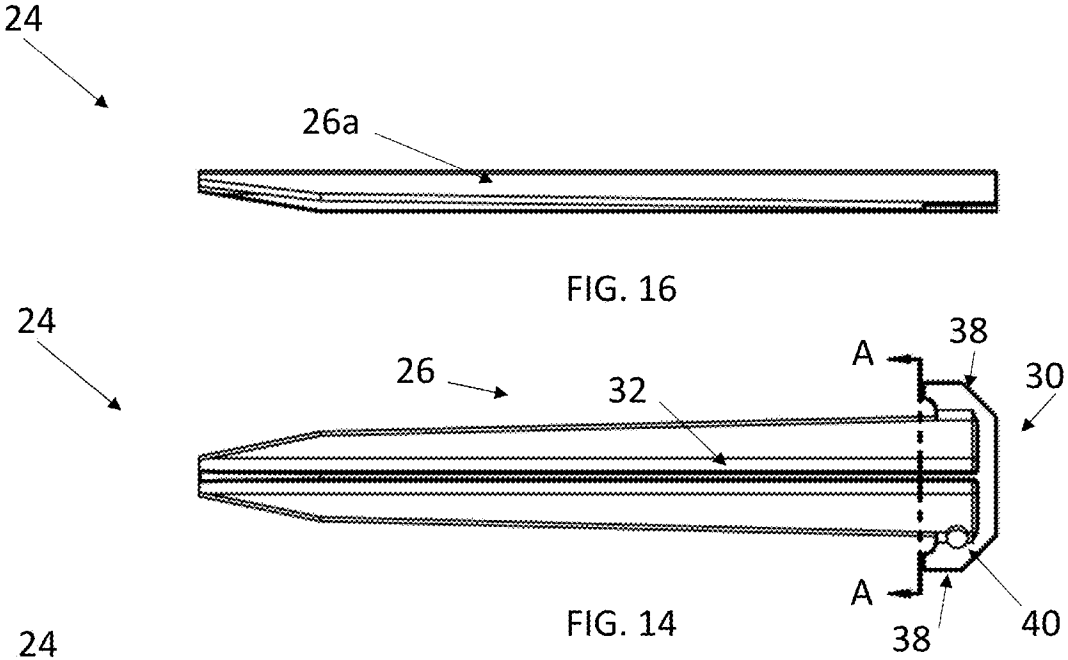
FIG. 16
FIG. 14
FIG. 15

SUPPORT POLE AND STAKE FOR NET SUPPORT SYSTEM

TECHNICAL FIELD

The present disclosure relates to net support system. More particularly, the present disclosure relates to a support pole and stake for a net support system.

BACKGROUND

The military uses large nets for concealing military objects, such as military equipment, personnel and installations. The large nets may be printed with multi-spectral camouflage and may range anywhere from a few square feet to hundreds of square feet. An exemplary multi-spectral camouflage is Ultra Lightweight Camouflage Net Systems (ULCANS). To install the net systems for concealing objects, a support system is provided. The support system may include shape disrupters, support poles, and stakes. Current support systems may not be compatible with all systems, may produce significant noise signatures, may buckle under normal operating conditions, may be difficult to recover and repack, may produce significant thermal and/or radar signatures, and may be heavy. Current support poles may produce a high noise signature when deployed and may be heavy. In order to adequately hold the nets to the ground surface, current stakes may be large and heavy. Thus, a need exists for a support system capable of supporting large nets and having a low thermal signature, a low radar signature, that is lightweight, easily deployed and recovered, and has sufficient wear resistance. A need further exists for support poles and stakes having reduced size, weight, and thermal signature.

BRIEF SUMMARY

According to an embodiment, a net support system includes a support pole configured to hold up a net; a shape disrupter having a conical body, the shape disrupter configured to interface with the support pole and to hold up the net; and a plurality of stakes having an elongated body with a central rib, the plurality of stakes configured to hold the net to a ground surface, wherein the support pole, the plurality of stakes, and the shape disrupter are formed of a non-metallic, non-conductive material and are radar transparent, and wherein each of the plurality of stakes has a weight less than about 0.23 lbs and a frictional surface area greater than about 36.2 square inches.

According to an embodiment, a stake for a net support system may include a body having an elongated portion and a head portion; and the elongated portion comprising a first side, a second side, and a central rib; and the head portion comprising one or more flanges, wherein the body is non-metallic, non-conductive, and radar transparent and wherein the stake has a weight less than about 0.23 lbs and a frictional surface area greater than about 36.2 square inches.

Additional features, advantages, and embodiments of the invention are set forth or apparent from consideration of the following detailed description, drawings and claims. Moreover, it is to be understood that both the foregoing summary of the invention and the following detailed description are exemplary and intended to provide further explanation without limiting the scope of the invention as claimed.

BRIEF DESCRIPTION OF THE DRAWINGS

The accompanying drawings, which are included to provide a further understanding of the invention and are incorporated in and constitute a part of this specification, illustrate preferred embodiments of the invention and together with the detailed description serve to explain the principles of the invention. In the drawings:

FIG. 14 shows a side view of a stake, according to an embodiment of the present disclosure;

FIG. 15 shows a side view, rotated 90° from the view of FIG. 14, of a stake, according to an embodiment of the present disclosure;

FIG. 16 shows a side view, rotated 180° from the view of FIG. 15, according to an embodiment of the present disclosure;

FIG. 17 shows a top view of a stake, according to an embodiment of the present disclosure;

FIG. 18 shows a cross-section along the axis A-A in FIG. 14, of a stake, according to an embodiment of the present disclosure;

DETAILED DESCRIPTION

Accordingly, one embodiment includes a net support system including one or more support poles configured to hold up a net(s), one or more stakes configured to hold the net to a ground surface, and one or more shape disrupters configured to interface with the support pole and to hold up the net. Each of the one or more support poles, each of the one or more stakes, and each of the one or more shape disrupters may be non-metallic, non-conductive, and radar transparent. The support poles may include a first end configured to interface with the shape disrupter and a second end, opposite the first end, configured to interface with the ground surface. The support system may include a storage case for storing the one or more shape disrupters, the one or more support poles, and the one or more stakes. A total weight of the support system may be minimized while maintaining strength and durability of the parts. A stake for the net support system may include a body having an elongated portion having a first side, a second side, and a central rib; and a head portion having one or more flanges. The stakes may be tapered at a distal end and may have a generally "E" shape in a sectional view. The stakes may have increased frictional surface area (e.g. due to the central rib) while minimizing weight as compared to conventional stakes.

Figure 1B:
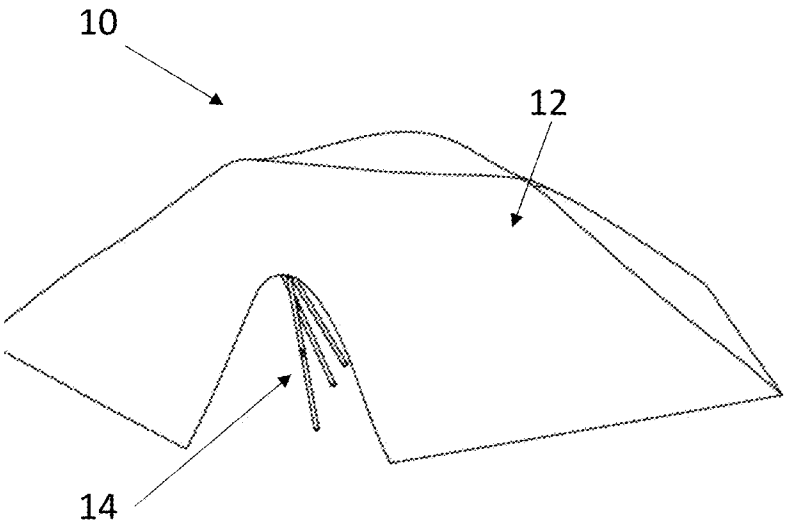
FIG. 1B shows a net having a net support system, according to an embodiment of the present disclosure.
Figure 1A:
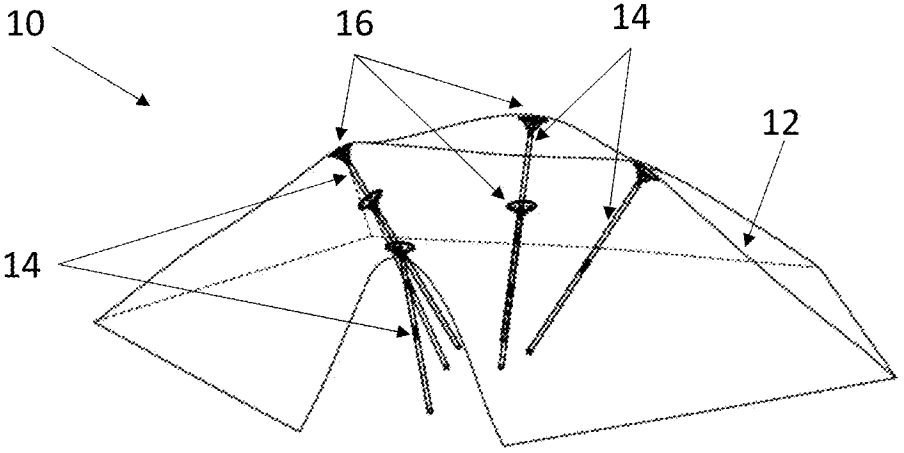
FIG. 1A shows a net having a net support system, according to an embodiment of the present disclosure.
Figure 2:
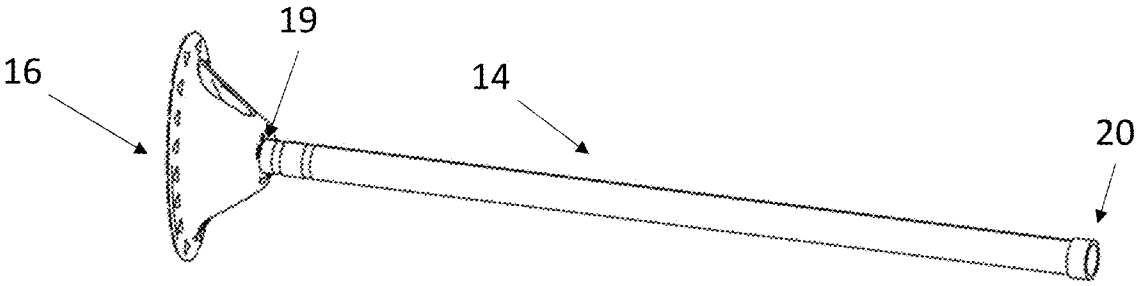
FIG. 2 shows a perspective view of a shape disrupter coupled to a support pole, according to an embodiment of the present disclosure.
Figure 3:
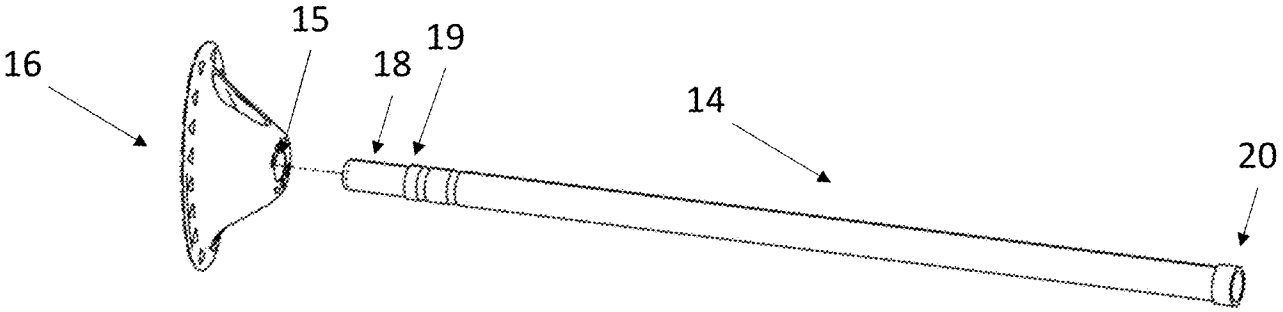
FIG. 3 shows an exploded view of a shape disrupter and a support pole, according to an embodiment of the present disclosure.
Figure 4:
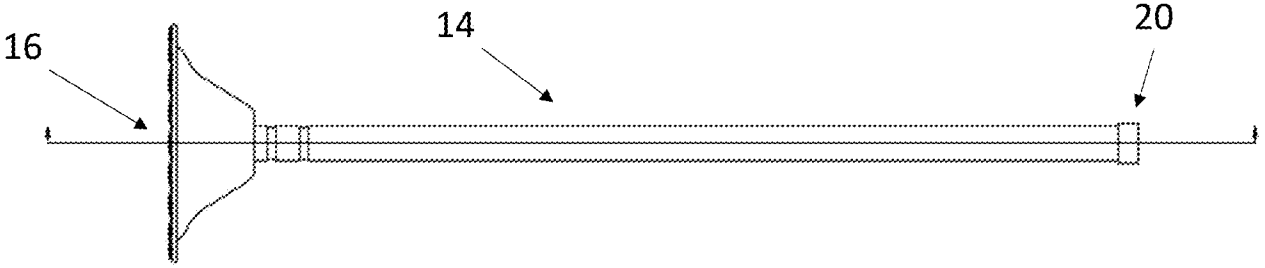
FIG. 4 shows a side view of a shape disrupter and a support pole, according to an embodiment of the present disclosure.
Figure 5:
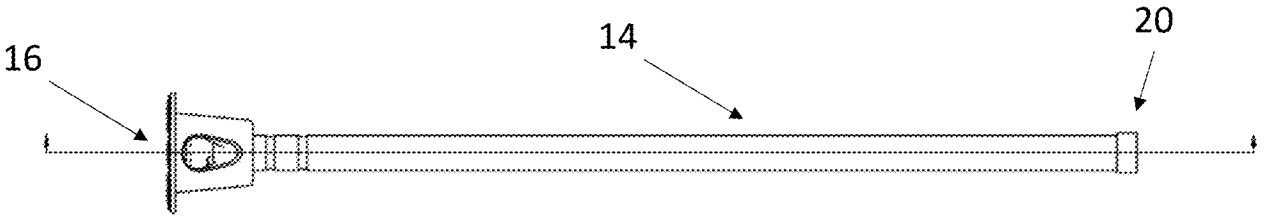
FIG. 5 shows a side view, rotated 90° from the view of FIG. 4, of a shape disrupter and a support pole, according to an embodiment of the present disclosure.
Figure 10:
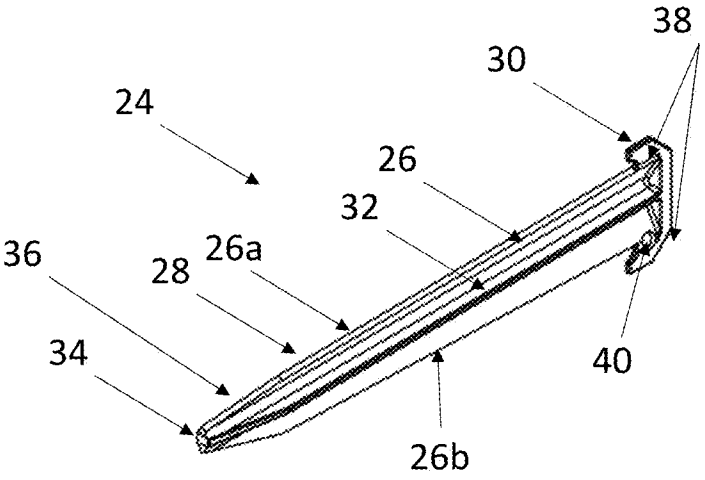
FIG. 10 shows a perspective view of a stake, according to an embodiment of the present disclosure.
Figure 13:
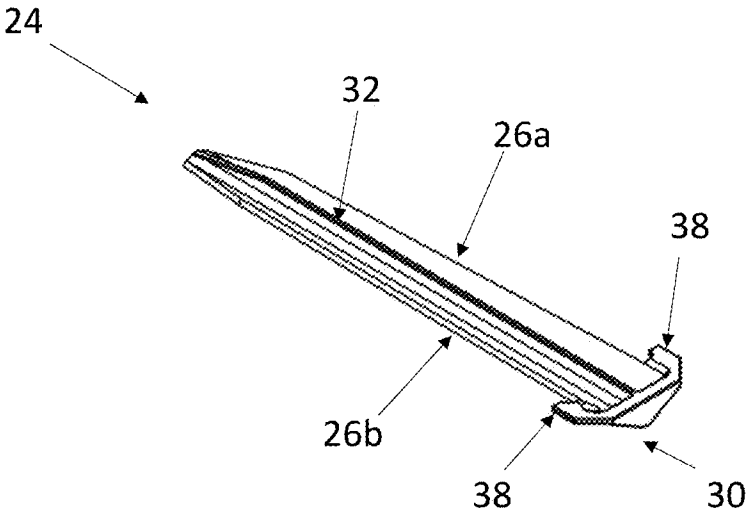
FIG. 13 shows a perspective view, rotated 90° from the view of FIG. 12, of a stake, according to an embodiment of the present disclosure.
Figure 12:
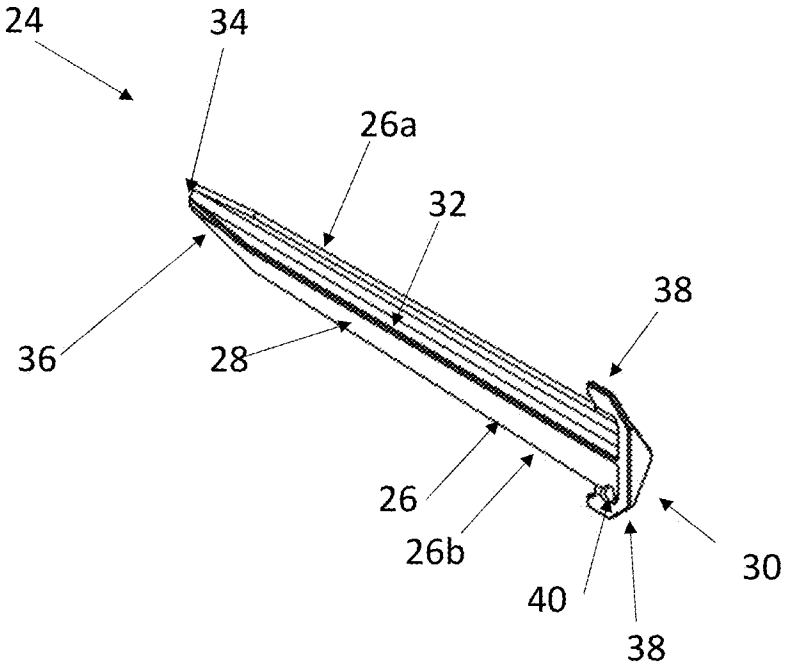
FIG. 12 shows a perspective view of a stake, according to an embodiment of the present disclosure.

Referring to FIGS. 1A and 1B, a net system 10 is shown. The net system 10 may include a net(s) 12 and a support system. The support system may include one or more support poles 14, one or more shape disrupters 16, and one or more stakes 24 (FIG. 10). The net 12 may be a camouflage net, such as an ultralight camouflage net found in an ULCANS. The net 12 may be a camouflage net such as found in co-pending application Ser. No. 15/690,685, herein incorporated by reference in its entirety. The net 12 may be of various sizes, such as, a large net able to cover large equipment, personnel, and/or building installations (e.g. military installations). The net 12 may be supported on one or more support poles 14 and one or more shape disrupters 16. The net 12 may be staked into the ground surface with one or more stakes 24 (FIG. 10).

Referring to FIGS. 2-9, each of the one or more shape disrupters 16 may be coupled to or may interface with a respective one of the one or more support poles 14. The one or more shape disrupters 16 may be known shape disrupters or may be the shape disrupters described in application U.S. Ser. No. 16/255,402 now U.S. Pat. No. 10,570,639 issued Feb. 25, 2020, herein incorporated by reference in its entirety. The shape disrupters 16 may be coupled to the support poles 14 at a first end 18. The first end 18 of the one or more support poles 14 may be received within an opening 15 of the shape disrupters 16. The coupling may be a snap fit, threading, or other coupling type. The first end 18 may have a shoulder 19 on which the shape disrupter 16 rests. As shown in FIG. 1, the shape disrupters 16 may be placed adjacent the net 12 to hold the net 12 above the equipment and/or personnel to be covered with the net system 10. A second end 20 of the support poles 14 (opposite the first end 18) may be located on the ground surface. Once erected, the net 12 may be staked into place in the ground surface with the one or more stakes 24 (FIG. 10).

Figure 6:
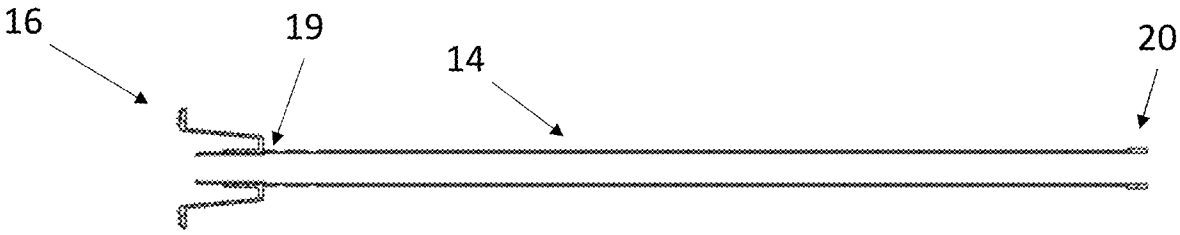
FIG. 6 shows a side cross-section, rotated 90° from the view of FIG. 4, of a shape disrupter and a support pole, according to an embodiment of the present disclosure.
Figure 7:
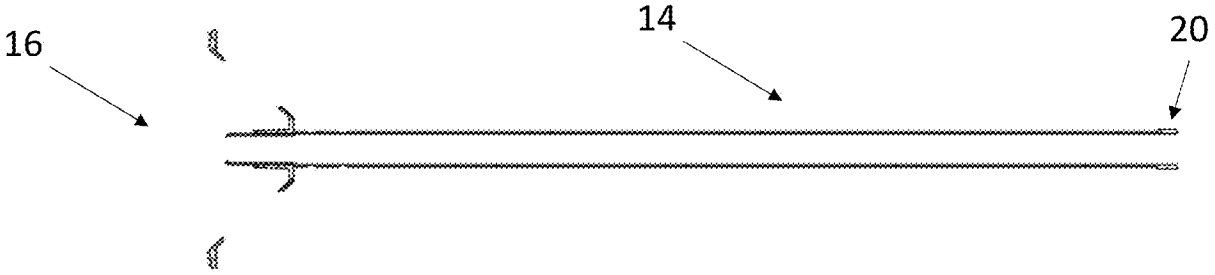
FIG. 7 shows a side cross-section, of a shape disrupter and a support pole, according to an embodiment of the present disclosure.
Figure 8:
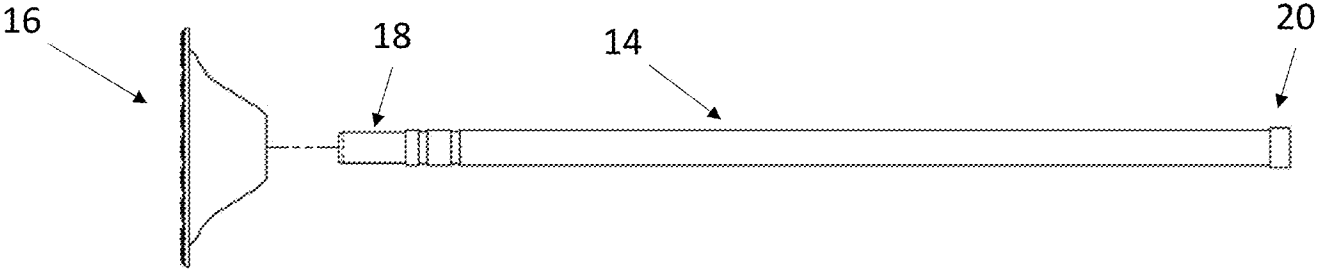
FIG. 8 shows an exploded view of a shape disrupter and a support pole, according to an embodiment of the present disclosure.
Figure 9:
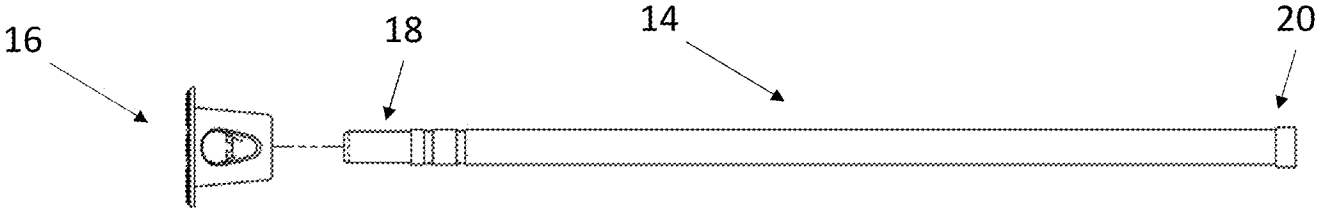
FIG. 9 shows an exploded view, rotated 90° from the view of FIG. 4, of a shape disrupter and a support pole, according to an embodiment of the present disclosure.
Figure 11:
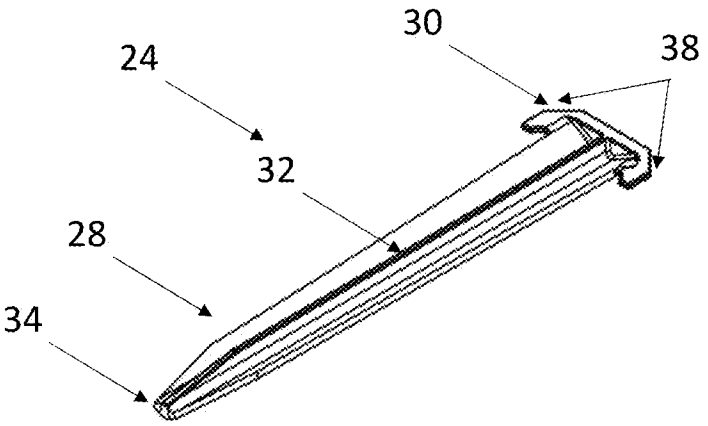
FIG. 11 shows a perspective view, rotated 90° from the view of FIG. 10, of a stake, according to an embodiment of the present disclosure.

As shown in FIGS. 6 and 7, the support pole 14 may be substantially cylindrical and/or tubular. The support pole 14 may be a hollow tube. The support pole 14 may extend a distance through the opening 15 and into an interior space of the shape disrupter 16. The one or more support poles 14 may comprise polyurethane resin. The one or more support poles 14 may be about 48 inches. The one or more support poles 14 may be compatible with conventional net support systems, such as ULCANS. The one or more support poles 14 ideally do not negatively impact the radar signature of the net system 10 when erected.

The support poles 14 may be constructed of a bi-stable reeled fiberglass composite or other non-metallic material. The support poles 14 may be constructed of a material that is able to fit within a prescribed packing volume, such as, for example 3.2 cubic feet or less, when in a stowed configuration. The one or more poles 14 may be non-conductive and/or flame resistant. The one or more poles 14 may be able to support the weight of a deployed net or screen. The one or more poles 14 may be able to support the weight of the deployed net or screen with standing water encountered during rainy conditions and/or with winds up to about 46 mph (about 74 km/h).

Figure 20:
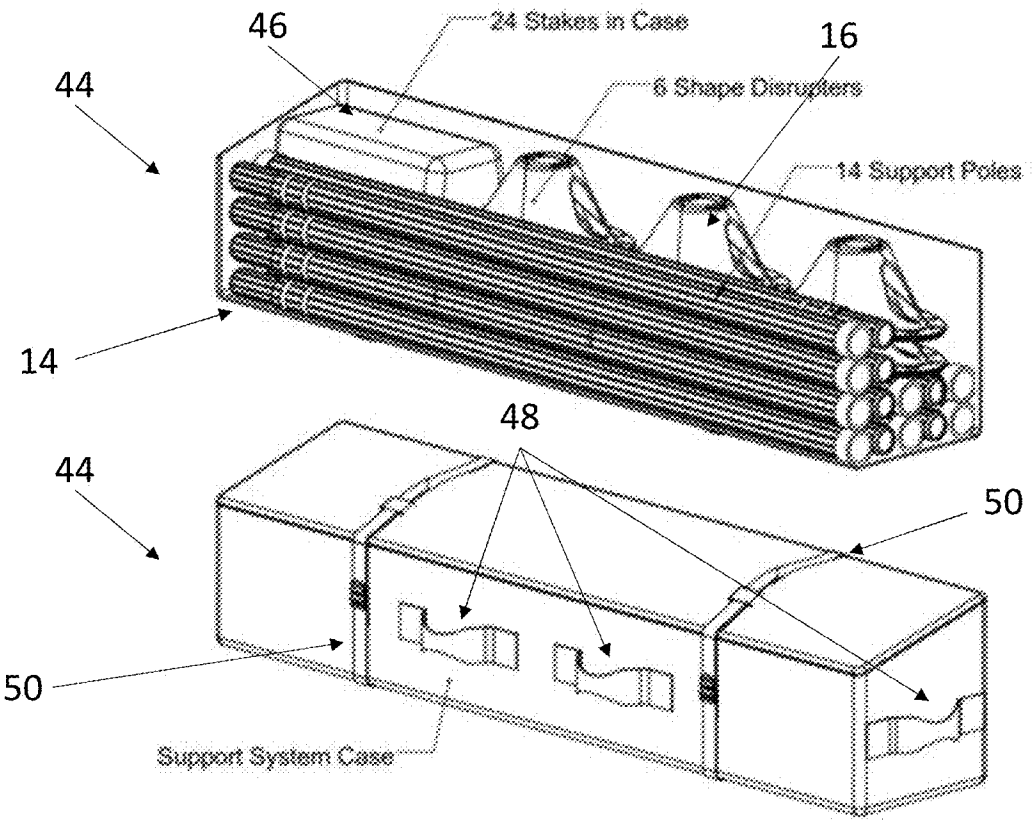
FIG. 20 shows a net support system in a packed condition, according to an embodiment of the present disclosure.

The support poles 14 may be rollable and/or collapsible. That is, the length of the support poles 14 may be opened flat and rolled back upon itself for storage. The rollable and/or collapsible support poles 14 may be interconnecting and interchangeable with the use of connecting adapters. The support poles 14 may be telescoping, stackable, and/or collapsible. That is, the longest dimension of any part or assembly may be no greater than about 48 inches (about 1.22 meters) in length. The longest dimension of any part or assembly may fit in the storage case 44 (FIG. 20). A clamp, pin, or lock may be used to retain the extended mode of the collapsible, telescoping, or stackable support poles 14. The clamp, pin, or lock may be operable without tools, may be field-repairable, and/or may be able to fully withstand the weight and stress of the support system. The support poles 14 may be able to support an axial load of 300 lbf when assembled.

FIGS. 10-18 show a stake 24 for use in the support system of net 12 (FIG. 1). The stake 24 may be formed of a non-metallic, non-conductive, and/or radar transparent material. The stake 24 may be formed of a material that produces a low noise signature when struck with a hammer, the noise signature may be lower than that produced with an aluminum or metal stake. The stake 24 may be formed of a high impact polymer. The stake 24 may be formed of a high tensile, high strength polymer. The stake 24 may have a frictional surface area that may be the amount of surface area of the stake 24 below the ground. The frictional area of the stake 24 may allow for the stake 24 to wedge and/or grab into the ground to support the net system 10. The frictional surface area of the stake 24 may be about 44.2 square inches. The weight of the stake 24 may be about 0.14 lbs. The weight of the stake 24 may be about 40% lighter in weight than the conventional metal and/or aluminum stakes, this may result in an overall reduction in weight of the 24 stakes from about 5.52 lbs for conventional stakes as compared to a set of 24 of stakes 24 having a weight of about 3.36 lbs. The reduced weight may result in easier transport of the net system 10.

With continued reference to FIGS. 10-18, the stake 24 may have a body 26. The body 26 may have an elongated portion 28 and a head portion 30. A central rib 32 may extend from the head portion 30 to a distal tip 34 of the elongated portion 28. The central rib 32 may extend between a first side 26*a* and a second side 26*b* of the body 26. The central rib 32 may provide strength to the stake 24. The central rib 32 may increase strength as compared to conventional stakes without ribs. The central rib 32 may allow for the stake 24 to hold in the ground even during wet and/or moist conditions. The central rib 32 may allow for the stakes 24, when provided in conjunction with the net system 10, to carry large (e.g. 30 feet) nets. The central rib 32 may allow for the stake 24 to have 22% more frictional surface area as compared to a stake without the central rib 32. The central rib 32 may allow for enhanced stability and adhesion in sand, dirt, wet, or wintry conditions.

The stake 24 may include a tapered portion 36 leading to the distal tip 34. The tapered portion 36 may facilitate entry of the stake 24 into the ground. The head portion 30 may include one or more flanges 38 for grabbing or resting on or near the top surface of the ground. The one or more flanges 38 may extend through a loop in the net (not shown) for securing the loop between the ground surface and the stake 24. The head portion 30 may include one or more openings 40. The head portion 30 of the stake 24 may have a substantially triangular shape in plan view, as shown, for example, in FIG. 17. Referring to FIG. 18, the distal tip 34 may appear as spokes due to the first side 26*a*, second side 26*b*, and central rib 32. The first side 26*a*, second side 26*b*, and central rib 32 may be angled with respect to one another. An angle between the first side 26*a* and the central rib 32 may be less than 90 degrees. An angle between the second side 26*b* and the central rib 32 may be less than 90 degrees. Although depicted in a generally "E" shape, the first side 26*a*, second side 26*b*, and central rib 32 may take other shapes, such as, for example, a "Y" shape. Other shapes and numbers of sides and ribs may be provided to achieve the desired frictional surface area while minimizing weight.

Accordingly, the stake 24 of FIGS. 10-18 provides a stake with a high frictional surface area (e.g. about 44.2 square inches), light weight (e.g. about 0.14 lbs), and a rugged design. A bag or case 46 (FIG. 20) may be provided to carry one or more stakes 24. The case may be formed of a water resistance coated nylon 500D Cordura fabric. The case may be designed with a drawstring opening for ease of deployment and recovery. The case may be sized for 24 stakes. The case may be sized to fit within the storage case 44 (FIG. 20).

In an exemplary embodiment, the stake 24 may have a frictional surface area of about 44.2 square inches with a weight of about 0.14 lbs. The stake 24 may have a frictional surface area between about 41.99 square inches and about 46.41 square inches, or between about 39.78 square inches and about 48.62 square inches, or between about 37.57 square inches to about 50.83 square inches. The stake 24 may have a frictional surface area above about 36.2 square inches. The stake 24 may have a weight between about 0.09 lbs and about 0.19 lbs, or between about 0.126 lbs and about 0.154 lbs, or between about 0.119 lbs and about 0.161 lbs. The stake 24 may have a weight below about 0.23 lbs. Any combination of frictional surface area and weight within the claimed ranges may be provided for the stake 24.

Figure 19:
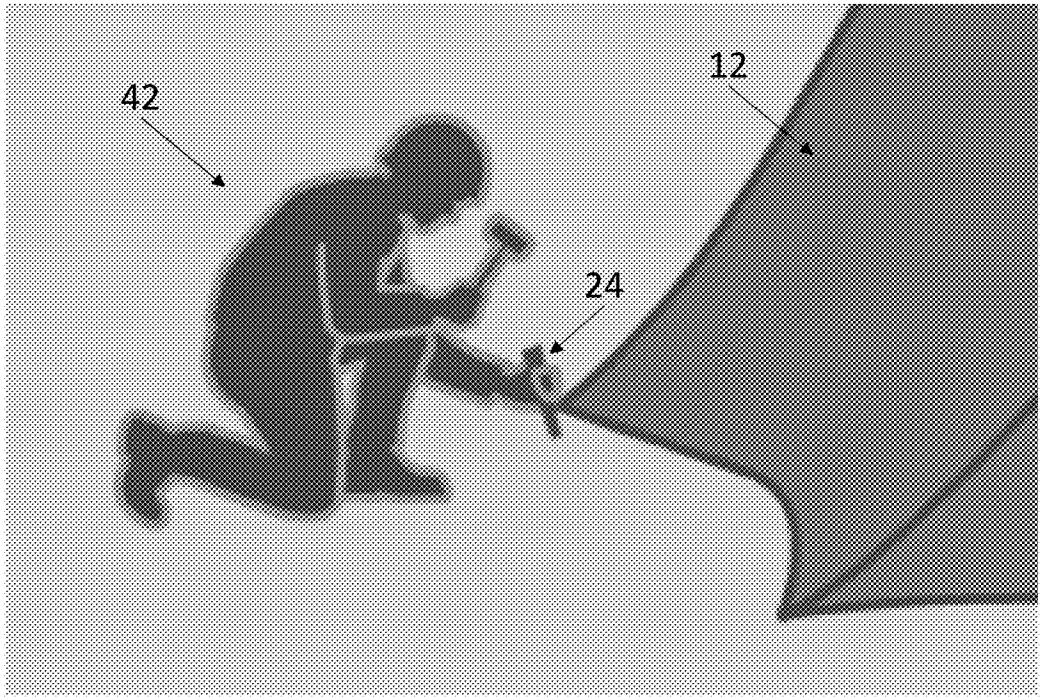
FIG. 19 shows an installation of a stake, according to an embodiment of the present disclosure.

FIG. 19 shows a schematic of the net system 10. A user 42 may couple the support poles 14 (not visible) to the shape disrupters 16 (not visible). The user 42 may then place the end of the support pole 14 opposite the shape disrupter 16 against the ground surface. The user 42 may install one or more support pole 14 and shape disrupter 16 assemblies. The user 42 may place the net 12 over the shape disrupters 16. The user 42 may extend the stakes 24 through a loop (not visible) in the net 12. The user 42 may then hammer the stake 24 into the ground surface. The stakes 24, support poles 14, and shape disrupters 16 may provide a net support system which secures the net 12 to the ground and allows the net 12 to extend around the items to be covered.

When the support system is not in use to hold a net 12 (FIG. 1), the support system may be stored in a storage case 44 such as shown in FIG. 20. The storage case 44 may hold the one or more support poles 14, the one or more shape disrupters 16, and the bag or case 46 for holding the one or more stakes. The storage case 44 may a hold a plurality of each of the components of the support system such that one or more nets 12 (FIG. 1) may be erected from the components of the storage case 44. For example, the storage case 44 may hold fourteen support poles 14, six shape disrupters 16, and twenty four stakes 24 (FIG. 10). Although other numbers of components are contemplated. 48 linear feet or 56 linear feet of the one or more poles 14 may be provided. The support system may have a volume of less than 3.57 cubic feet when stored in the storage case 44. The support system may have a volume of about 2.70 cubic feet when stored in the storage case 44. The storage case 44 may allow for ease of deployment and recovery. The storage case 44 may be formed to remain dry and allow for ease of carrying for the user. The storage case 44 may be formed of a water resistant coated nylon 500D Cordura fabric. The storage case 44 may have a zippered top. The storage case 44 may have one or more handles 48. The one or more handles 48 may be provided on all sides and may be balanced to accommodate all human factors as described in MIL-STD-1472. The storage case 44 may be about 10 inches×50 inches×9.5 inches. The storage case 44 may be rolled and stowed when not in use (e.g. when the components of the support system are removed). Additional straps 50 may be provided in the event of zipper failure.

All of the aforementioned components may be non-conductive and radar transparent. In a kit having the storage case 44, the stake case 46, six shape disrupters, twenty four stakes 24, and fourteen poles 14, the total weight may be about 39.9 lbs. The storage case 44 may weigh about 1.9 lbs, the stake case 46 may weigh about 0.5 lbs, the six shape disrupters may weigh about 4.0 lbs, the twenty four stakes 24 may weight about 3.4 lbs, the fourteen poles 14 may weigh about 30.2 lbs. Thus the total weight may allow for one user to carry and lift the system. In a kit having the storage case 44, the stake case 46, six shape disrupters, twenty four stakes 24, and twelve poles 14, the total weight may be about 35.6 lbs. The storage case 44 may weigh about 1.9 lbs, the stake case 46 may weigh about 0.5 lbs, the six shape disrupters may weigh about 4.0 lbs, the twenty four stakes 24 may weight about 3.4 lbs, the twelve poles 14 may weigh about 25.9 lbs. Thus the total weight may allow for one user to carry and lift the system. The total weight may be between about 25 lbs and about 45 lbs.

The support system (e.g. support poles 14, shape disrupter 16, and stakes 24) of the present disclosure may be stowed in its own package (e.g. storage case 44). The components of the support system may be matte black in color to limit the amount of glint, glare, and gloss produced by the support system. The support system may be interchangeable between all classes and types of nets and may be compatible with conventional nets, such as existing ULCANS. The support system may be radar transparent, non-conductive, non-metallic, and may not negatively affect the overall signature of the erected ULCANS or the items being concealed or camouflaged.

In an exemplary embodiment, each support system may include a minimum of about 56 linear feet (about 17.07 linear meters) of support poles 14. A user may be able to form at least five 8 foot (about 2.44 meters) poles in each support system. The deployed support pole length may be at least about 16 feet (about 4.88 meters). In an exemplary embodiment, the support system of the present disclosure may have a heat retention of 128 degrees for 60 minutes of thermal loading. The plurality of cut outs present in the shape disrupter 16 may assist in reducing the weight and thermal signature.

Only exemplary embodiments of the present invention and but a few examples of its versatility are shown and described in the present disclosure. It is to be understood that the present invention is capable of use in various other combinations and environments and is capable of changes or modifications within the scope of the inventive concept as expressed herein.

Although the foregoing description is directed to the preferred embodiments of the invention, it is noted that other variations and modifications will be apparent to those skilled in the art, and may be made without departing from the spirit or scope of the invention. Moreover, features described in connection with one embodiment of the invention may be used in conjunction with other embodiments, even if not explicitly stated above.

The invention claimed is:

1. A net support system comprising:

a support pole configured to hold up a net;

a shape disrupter having a conical body, the shape disrupter configured to interface with the support pole and to hold up the net;

wherein the conical body of the shape disrupter connects at a relatively narrow end of the conical body to an end of the support pole so that the interior of the shape disrupter conical body faces the net to hold up the net and a relatively wider end of the conical body holds up the net; and a plurality of stakes having an elongated body with a central rib, the plurality of stakes configured to hold the net to a ground surface, wherein the support pole, the plurality of stakes, and the shape disrupter are formed of a non-metallic, non-conductive material and are radar transparent.

2. The net support system of claim 1, wherein the support pole is formed of polyurethane resin.

3. The net support system of claim 1, wherein each of the plurality of stakes is formed of a high impact polymer.

4. The net support system of claim 1, wherein the weight of the stake is about 0.14 lbs and the frictional surface area of the stake is about 44.2 square inches.

5. The net support system of claim 1, wherein the weight of the stake is between about 0.119 lbs and about 0.161 lbs and the frictional surface area of the stake is between about 37.57 square inches and about 50.83 square inches.

6. The net support system of claim 1, further comprising a plurality of support poles, a plurality of shape disrupters, and a storage case for storing the plurality of shape disrupters, the plurality of support poles, and the plurality of stakes.

7. The net support system of claim 6, wherein a total weight of the plurality of support poles, the plurality of stakes, the plurality of shape disrupters, the storage case, and a stake case for storing the plurality of stakes is between about 25 lbs and about 45 lbs.

8. The net support system of claim 7, wherein the total weight is 30.2 lbs or 39.9 lbs.

9. The net support system of claim 7, wherein, in a stored condition, the plurality of shape disrupters, the plurality of support poles, and the plurality of stakes have a volume of about 2.7 cubic feet.

10. A support pole for a net support system comprising:

a support pole configured to hold up a net;

a shape disrupter having a conical body, the shape disrupter configured to interface with the support pole and to hold up the net;

wherein the conical body of the shape disrupter connects at a relatively narrow end of the conical body to an end of the support pole so that the interior of the shape disrupter conical body faces the net to hold up the net and a relatively wider end of the conical body holds up the net; and wherein the support pole and the shape disrupter are formed of a non-metallic, non-conductive material and are radar transparent.

* * * * *